US005259592A

United States Patent [19]

King

[11] Patent Number: 5,259,592

[45] Date of Patent: Nov. 9, 1993

[54] LEAF SPRING VALVE AND METHOD

[75] Inventor: Patrick D. King, Rantoul, Ill.

[73] Assignee: Flo-Con Systems, Inc., Champaign, Ill.

[21] Appl. No.: 926,925

[22] Filed: Aug. 7, 1992

Related U.S. Application Data

[63] Continuation-in-part of Ser. No. 785,492, Oct. 31, 1991, which is a continuation-in-part of Ser. No. 539,582, Jun. 18, 1990, Pat. No. 5,062,553, which is a continuation-in-part of Ser. No. 495,587, Mar. 16, 1990, abandoned.

[51] Int. Cl.[5] ..... B22D 41/28

[52] U.S. Cl. ..... 266/45; 266/236; 222/600

[58] Field of Search ..... 266/45, 236; 222/590, 222/591, 597, 600

[56] References Cited

U.S. PATENT DOCUMENTS

| | | | |
|---|---|---|---|
| 4,415,103 | 11/1983 | Shapland et al. | 222/600 |
| 4,545,512 | 10/1985 | Shapland et al. | 222/600 |
| 5,052,598 | 10/1991 | King et al. | 222/600 |
| 5,062,553 | 11/1991 | King | 222/600 |

*Primary Examiner*—Scott Kastler
*Attorney, Agent, or Firm*—Jack E. Dominik

[57] ABSTRACT

A sliding gate valve having a frame, a sliding carrier within the frame, means for securing the carrier in reciprocating relationship to the frame, a stationary plate secured at the upper portion of the valve, and a slide gate secured at the lower portion of the valve is disclosed. In one embodiment a spring plate is provided with beam springs cantileverly mounted on its under side having their end portions oriented in surrounding relationship to the teeming opening of the valve, and in addition, providing a cluster of such springs at the shut-off portion of the slide gate which underlies the teeming opening to the vessel in the shut-off position. As to the spring plate, the springs extend downwardly to engage a spring pressure raceway ring formed in the interior portion of the carrier throughout its length and width and partially surrounding the teeming opening of the valve. In addition, a spider-like cluster of springs is provided underneath the shut-off portion to load it when in the shut-off position. The method comprises positioning beam springs in a valve environment to the end that they surround the teeming opening in close proximate relation thereto, and have an auxiliary positioning of a cluster of springs to underlie a shut-off portion of the plate. In addition, the valve relates to the utilization of a bobtailed-type spring plate which is not bilaterally symmetrical in conjunction with a refractory plate in the sliding gate portion of a sliding gate valve.

31 Claims, 9 Drawing Sheets

LEAF SPRING VALVE AND METHOD

CROSS-REFERENCE TO RELATED APPLICATIONS

The present application is a continuation-in-part of application Ser. No. 785,492 filed Oct. 31, 1991, entitled "Leaf Spring Valve and Method"; which in turn is a continuation-in-part of application Ser. No. 539,582 filed Jun. 18, 1990, issued into U.S. Pat. No. 5,062,443 dated Nov. 5, 1991; which is a continuation-in-part of application Ser. No. 494,587 filed Mar. 16, 1990 and entitled "Cantilever Spring Mount for Sliding Gate Valve and Method", now abandoned.

FIELD OF THE INVENTION

The present invention relates to a sliding gate valve commonly used in the teeming of molten metal such as steel. More specifically, it relates to a sliding gate reciprocating valve having two or more opposed sliding plates such as disclosed in U.S. Pat. No. 4,063,668.

SUMMARY OF THE PRIOR ART

The prior art is best exemplified by U.S. Pat. No. 4,063,668 which is a sliding gate reciprocating valve having a plurality of pressure pads activated by coil springs which engage a slide gate in a carrier which slide gate, in turn, engages a stationary plate. The two plates each have a teeming orifice which are moved in and out of alignment to control the flow of steel from a vessel to which the valve is mounted. A three plate sliding gate valve is disclosed in FIG. 15 of U.S. Pat. No. 4,063,668. Additionally, the prior art discloses bandless refractories for use in such type valve as appearing in U.S. Pat. Nos. 4,573,616 of Mar. 4, 1986 and 4,582,232 of Apr. 15, 1986. Finally, U.S. Pat. No. 4,561,573, issued Dec. 31, 1985, discloses the use of a pressure plate positioned underneath the slide gate in order to more uniformly transfer the loads from the discrete pressure points applied by the coil spring pads of U.S. Pat. No. 4,063,668.

A distinct problem may arise with the negligent use of the valve such as exemplified in U.S. Pat. No. 4,063,668 since the coil springs cannot operate satisfactorily at temperatures exceeding 800° F. Indeed, it is most desirable that the temperature not exceed 400° F. to 600° F. This is a peculiar property of coil springs as set forth in applicant's co-pending patent application Ser. No. 539,582, filed Jun. 18, 1990, now U.S. Pat. No. 5,062,553. There it was recognized that certain forms of tool steel can be used when a cantilever spring is employed. Such steels can withstand temperatures of up to 1100° F. and still endure fatigue and flex within the elastic limits for hundreds of thousands of deflections. An exemplary coil spring is shown in the environment of a typical tundish valve such as shown in U.S. Pat. No. 4,415,103. Such springs are, however, linearly mounted and apply, for the tundish valve environment, the necessary pressure to hold the two sequential refractory plates in pressure face to face and leak proof contact. However, as is well known in the art, when the ferrostatic pressure of a ladle gate valve is encountered which is many times the ferrostatic pressure of a sequential tundish valve, leakage can occur. This problem was addressed and contained by following the structure and method as shown in U.S. Pat. No. 4,063,668.

Nonetheless, despite all of the technology as set forth in the prior art above, the U.S. Pat. No. 4,063,668 patent structure is vulnerable to the negligent loss of cooling air. In more than one instance where the cooling air was negligently taken off of the valve, and the ladle set aside with a charge of molten metal, the springs of the valve elevated to a temperature where leakage occurred. It follows that it is highly desirable to develop a valve in which no cooling air is required, and the safety factor for excessive heat on the springs is readily accommodated by ambient air. In addition, it is highly desirable to develop such a valve in which a bandless refractory such as exemplified in U.S. Pat. Nos. 4,573,616 and 4,582,232 can be employed. The clamping rings and the force components exerted eliminate the necessity for mounting refractory in a mortar and a container. This overcomes irregularities and manufacturing problems which result from a metal encased refractory not having two parallel planar faces. Coil springs have been omitted in favor of a single Belleville spring around the collector as shown in U.S. Pat. No. 4,358,034. Also a spring toggle slide gate valve is shown in U.S. Pat. No. 4,199,085. Such a spring does not address surface irregularities remote from the teeming orifice.

In view of the foregoing, it becomes apparent that what is needed is a valve in which the springs do not require air cooling, in which the load of the springs is uniformly distributed to the refractory, and in which the refractory may be of the bandless highly secured type, and in which a pressure plate is optionally employed which will uniformly distribute the force of the springs over the refractory to thereby cause a superb face to face sealed relationship between the stationary plate or plates and the slide gate or sliding plate. In addition, the valve should desirably have means for self-energizingly engaging the stationary plate which, as the slide plate, is also bandless in nature and has the two component force securing the same to the valve. Also, it is desirable to reduce the spring rate in any such valve to thereby increase the amount of deflection for a given load and accommodate additional temperature variations, structural deflection, or dimensional inaccuracies.

SUMMARY OF THE INVENTION

The present invention is directed to a sliding gate valve having a frame, a sliding carrier within the frame, means for securing the carrier in reciprocating relationship to the frame, a stationary plate secured at the upper portion of the valve, and a slide gate secured at the lower portion of the valve. In one embodiment a spring plate is provided with beam springs cantileverly mounted on its under side having their end portions oriented in surrounding relationship to the teeming opening of the valve, and in addition, providing a cluster of such springs at the shutoff portion of the slide gate which underlies the teeming opening to the vessel in the shut-off position. This mounting may be reversed with the springs secured cantileverly to the carrier and the spring plate eliminated while the springs bear directly on the underside of the metal encased refractories. All of the springs are fixedly mounted for cantileverly applying a yieldable load. As to the spring plate, the springs extend downwardly to engage a spring pressure raceway ring in the interior portion of the carrier throughout its length and width and partially surrounding the teeming opening of the valve. In addition, a spider-like cluster of springs is provided underneath the shutoff portion to load it when in the shut-off position.

In yet another embodiment, a spring plate having springs cantileverly mounted on both sides is positioned between the slide gate and the carrier. This results results cutting the spring rate in half. Other embodiments with double springing such as reversely folding a pair of said springs upon each other also cut the spring rate in half. Yet another embodiment with spring pairs mounted on each other on one side of the spring plate and a single spring on the other side cuts the spring rate to one-third of that of a single spring. To cut the spring rate to one fourth, doubled springs are used on both faces of the spring plate. The method comprises positioning beam springs in a valve environment to the end that they surround the teeming opening in close proximate relation thereto, and have an auxiliary positioning of a cluster of springs to underlie a shutoff portion of the plate. In addition, the valve relates to the utilization of a bobtailed-type spring plate which is not bilaterally symmetrical in conjunction with a refractory plate in the sliding gate portion of a sliding gate valve.

In view of the foregoing, it is a principal object of the present invention to provide a sliding gate valve in which the springs can operate without being cooled by an independent pressure air source.

A further object of the present invention is to provide a sliding gate valve in which bending beam springs are employed in conjunction with a spring plate which, in addition to exerting pressure uniformly on the sliding refractory, also serves to couple a collector nozzle in place beneath the pressure plate.

An additional and important object of the present invention is to provide, in one embodiment, a spring plate and associated springs which cuts the spring rate in half, thereby doubling the deflection required to impose a given load. This imparts additional flexibility to the entire assembly of the valve.

A further advantage of the present invention stems from the forming of the spring plate with an interior thickened section so that it resists the bending moment of the beam springs positioned at its exterior as well as offsets the inherent sag occurring in the spring plate as a result of elevated temperatures, particularly where the spring plate is in close proximity to the teeming orifice of the valve.

Yet another object of the present invention is to provide a valve construction with significantly improved spring support means which permit the steel maker to readily withdraw and service and inspect each and every spring plate at each and every replacement of the refractory and the return of the same to service.

Not to be overlooked is the advantage of the utilization of cantilever springs in a sliding gate valve since the cantilever spring metal construction is not of the exotic variety, is readily obtainable, and thereby reduces the cost in addition to augmenting the life of such springs.

BRIEF DESCRIPTION OF THE DRAWINGS

The foregoing objects and advantages will be more fully understood taken in conjunction with a description of the subject sliding gate valve as exemplified in the attached drawings, in which.

DESCRIPTION OF PREFERRED EMBODIMENTS

Figure 1:
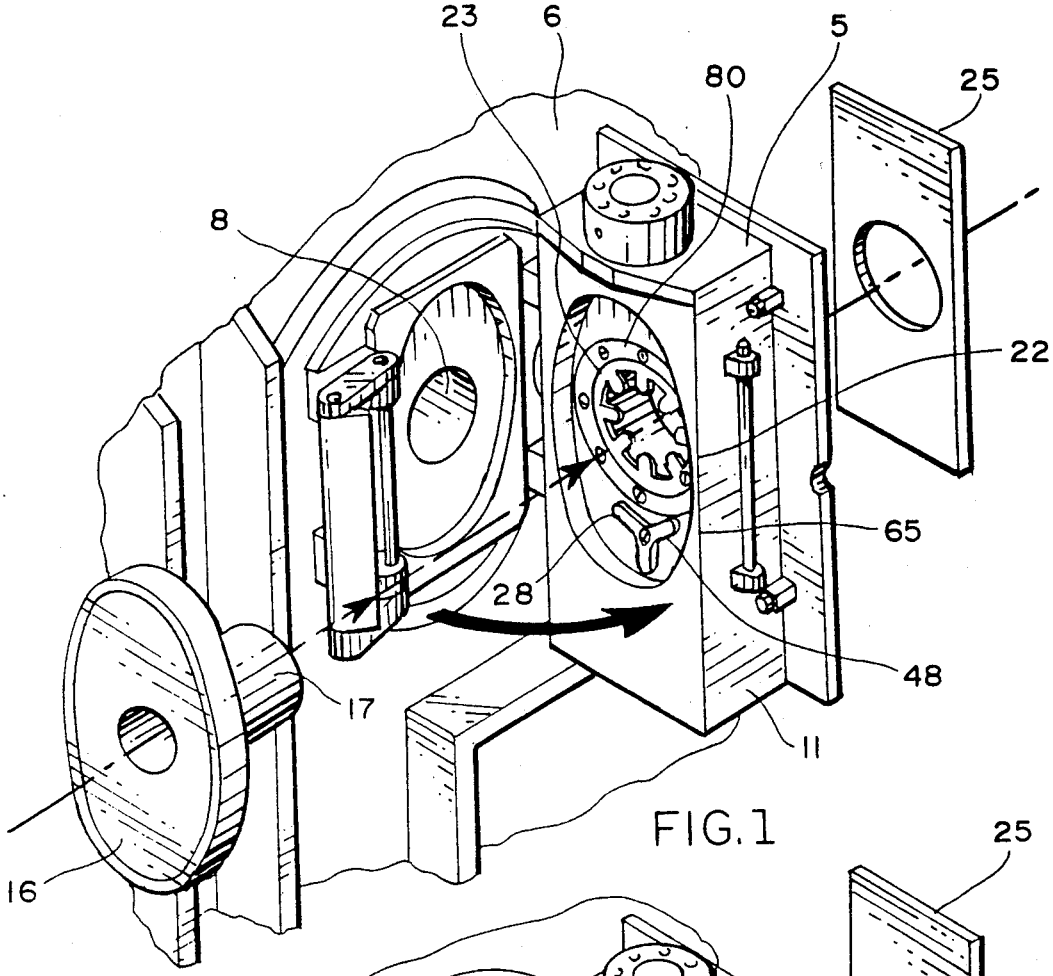
FIG. 1 is a perspective view of an illustrative valve opened to show a star spring type construction.

An illustrative valve 5 is shown in FIG. 1. There it will be seen that the basic members include a vessel wall 6 to which the valve 5 is secured in surrounding relationship to a well nozzle 8. A carrier 11 is provided in order to receive the slide gate plate 16 and its collector nozzle 17. Subsequently a heat shield 25 is secured to the underneath portion of the carrier 11. The star spring 22 has a heel ring 23 as shown in greater detail in FIG. 3. Provision is also made for a three leaf spring 28 having a cantilever portion 48 which engages the under portion of the slide plate 16.

Figure 2:
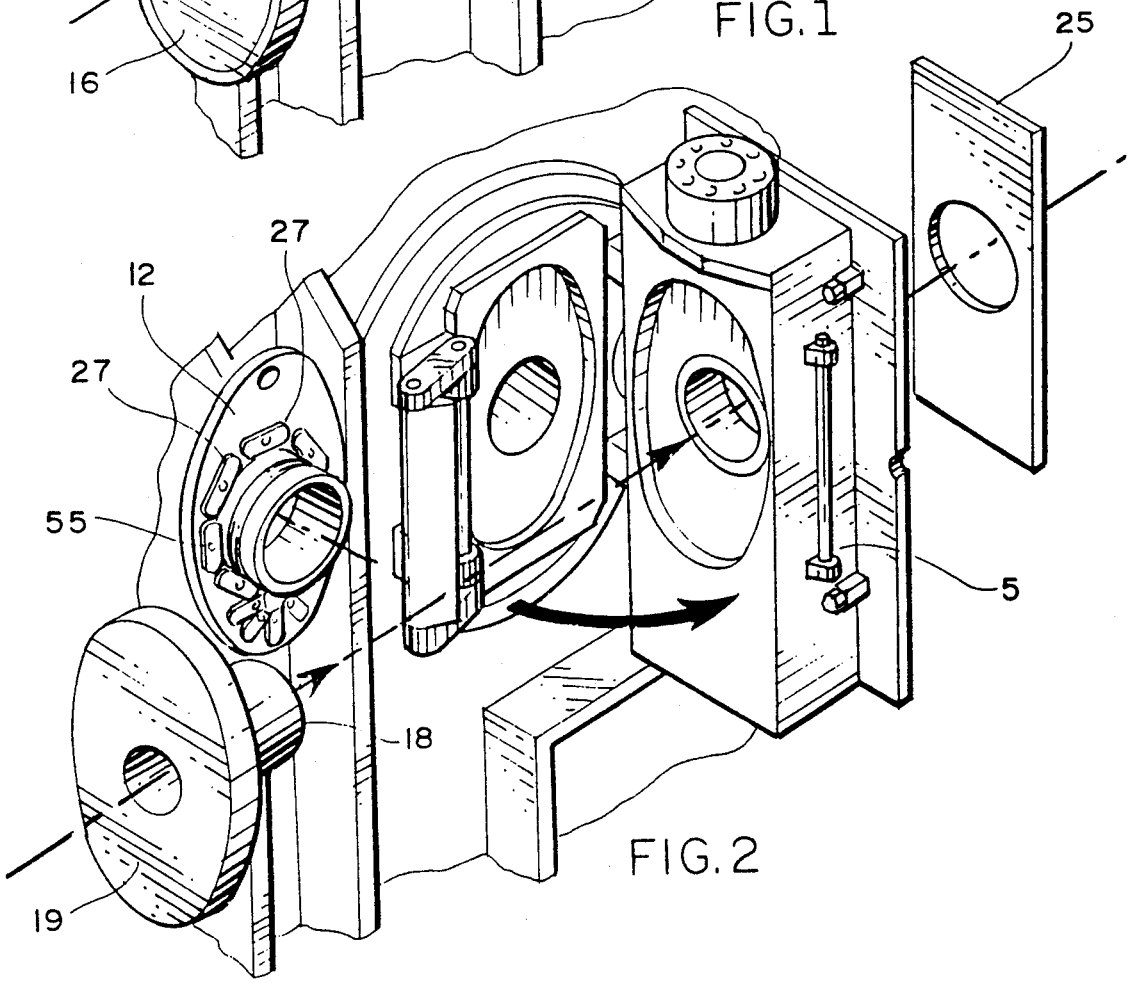
FIG. 2 is a view of an alternative embodiment utilizing a spring plate in which beam springs are employed.
Figure 8:
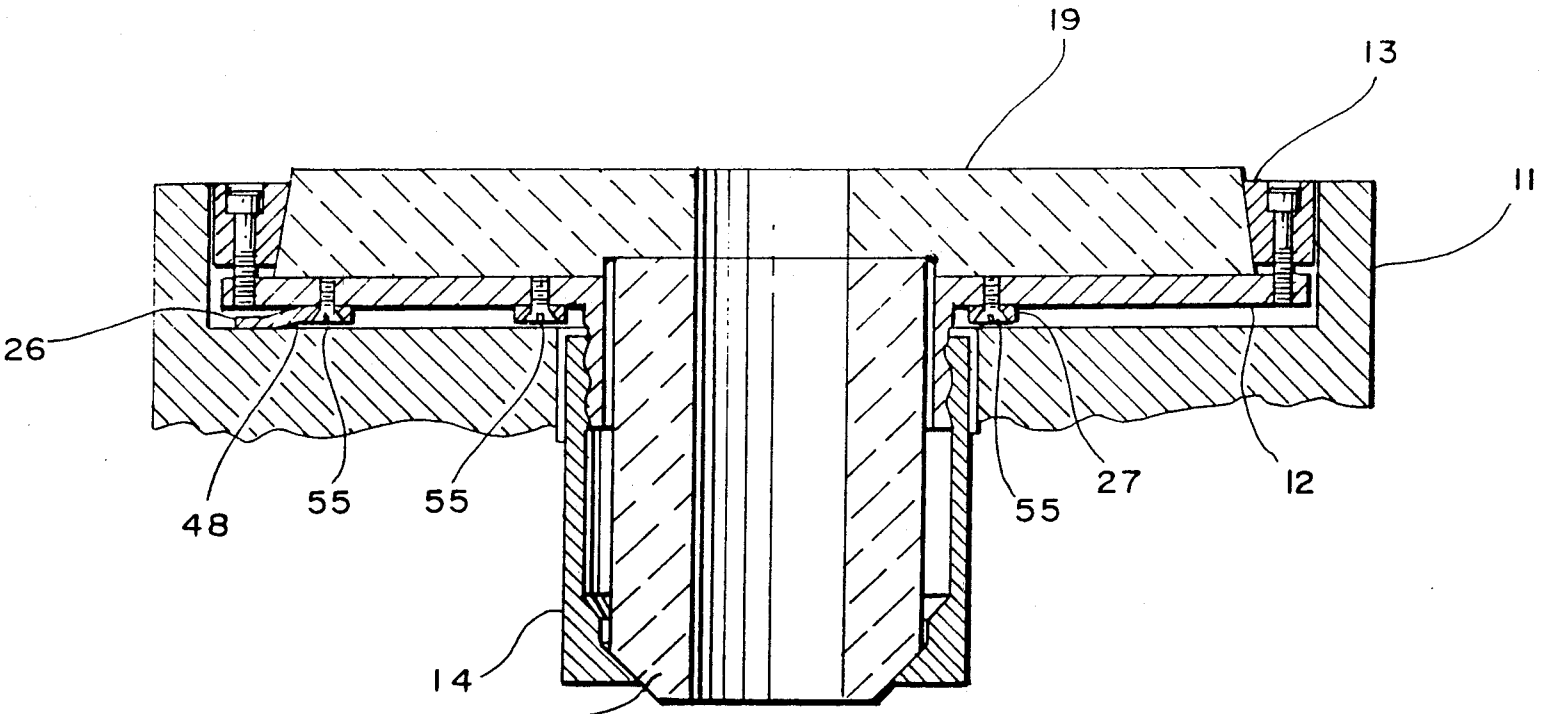
FIG. 8 is a further longitudinal sectional view of FIG. 7, but showing the environment of the sliding plate and depending nozzle in conjunction with the spring plate and, in addition, the clamping mechanism for the slide plate portion.

The alternative embodiment as shown in FIG. 2 is provided with a spring plate 12 having an associated clamp ring 13 (as shown in FIG. 8). The beam springs 27 are individually secured to the spring plate 12 by means of a mounting bolt 55. The slide plate 19 is uncanned or unbanded as is also the replaceable collector 18.

Figure 3:
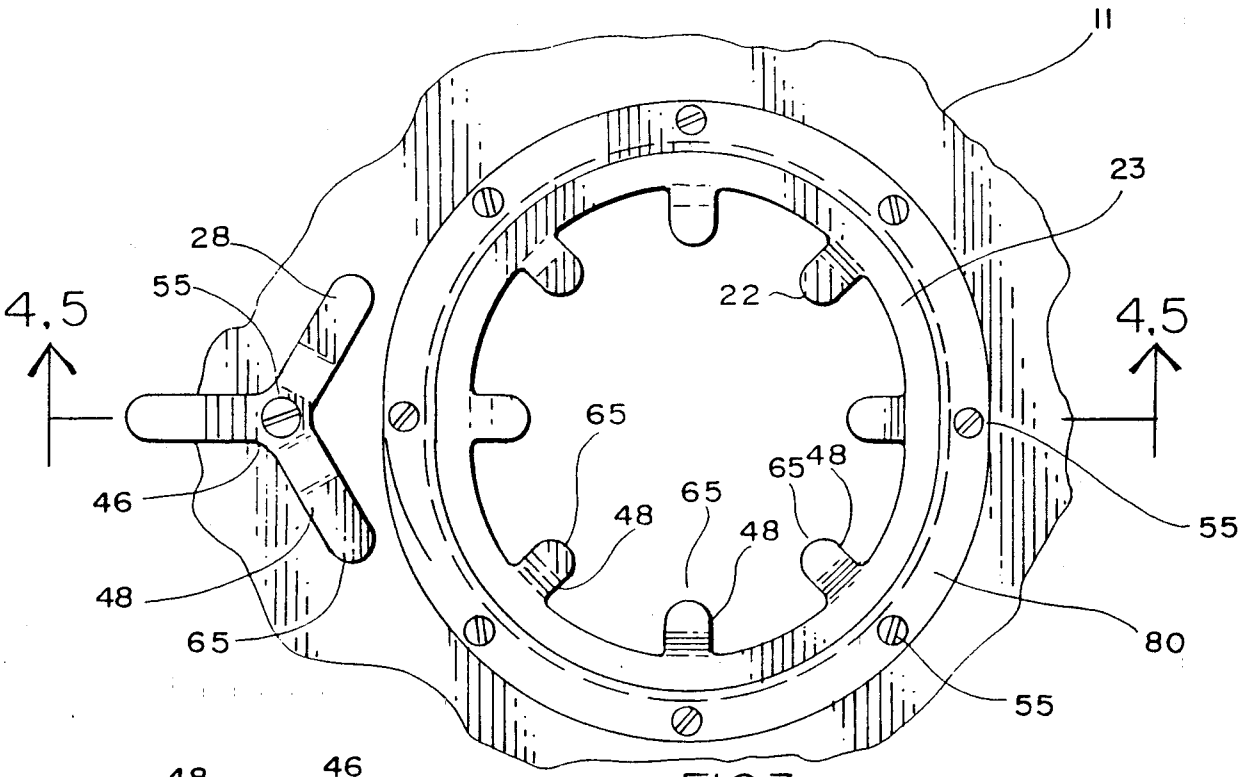
FIG. 3 is a plan view of the carrier of the subject valve with the pressure plate and refractory removed.

More specifically, the embodiment as shown in perspective in FIG. 1 is shown in plan view in FIG. 3. There it will be seen in greater detail that the carrier 11 supports the heel ring 23 from which the star springs 22 extend inwardly and upwardly. The heel ring 23 is secured to the carrier by means of the bolts 55. A clamp 80 provides the vehicle for this securement. In greater detail it will be seen that the cantilever portion 48 of the springs 22 extends to a working face 65 interiorly which, in turn, abuts the underneath portion of the slide gate 16.

Figure 4:
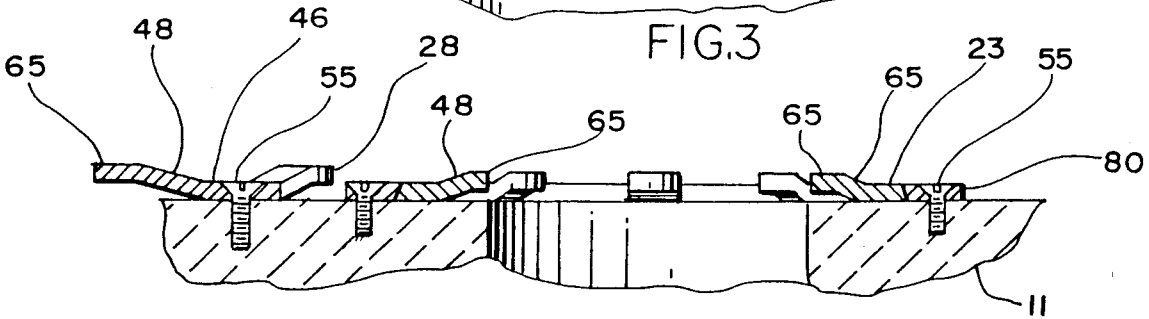
FIG. 4 is a longitudinal section illustrating the cantilever springs taken along section line 4—4 of FIG. 3.
Figure 5:
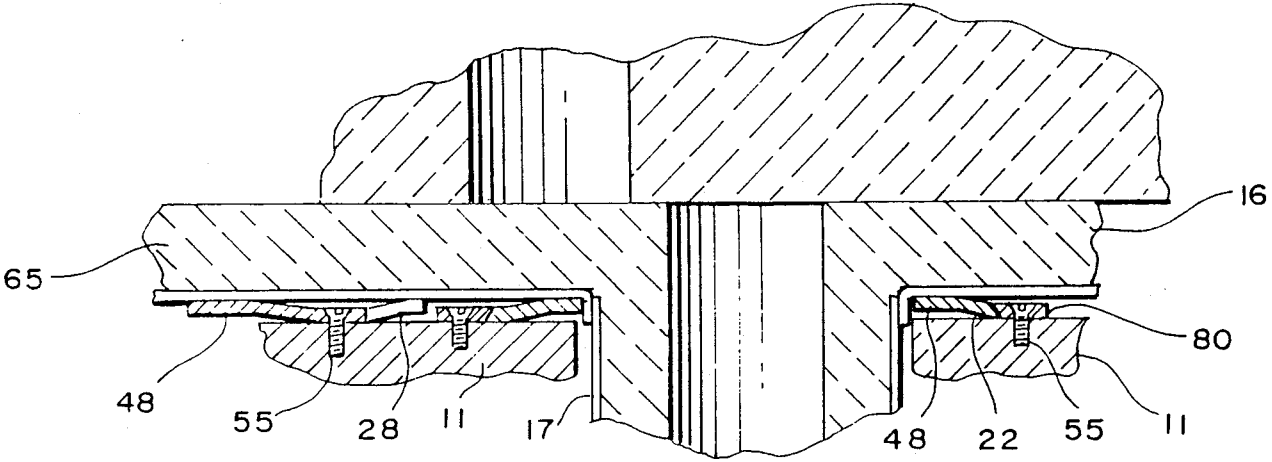
FIG. 5 is a view of the orientation of the cantilever springs as shown in FIG. 3 taken along section line 5—5 of FIG. 3.

The three leaf spring assembly 28 is shown in the left-hand portions of FIGS. 3 and 4 and is also secured to the carrier 11 by means of mounting bolt 55. Similar reference numerals have been employed for the cantilever portion 48 and the working face 65. FIG. 5 illustrates the mounted relationship between the slide plate 16 and both the star springs 22 and the three leaf spring 28. The star spring 22 is in surrounding relationship to the collector nozzle.

Figure 6:
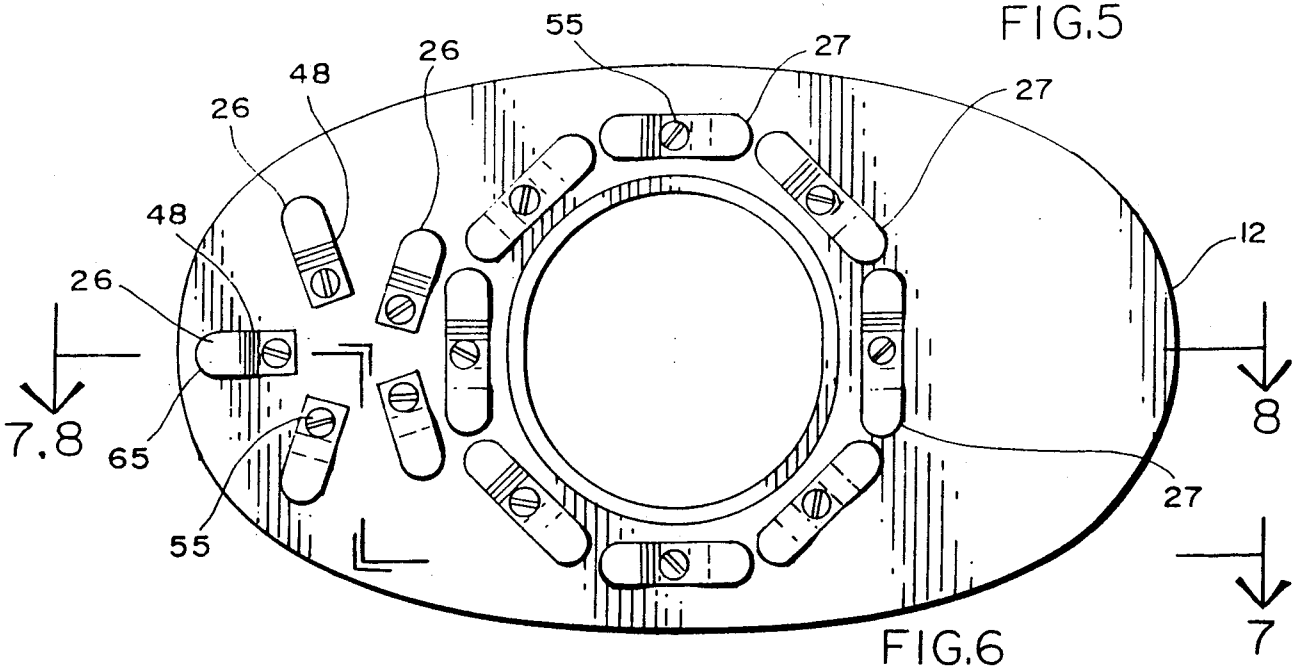
FIG. 6 is a plan view of the underneath portion of the spring plate.
Figure 7:
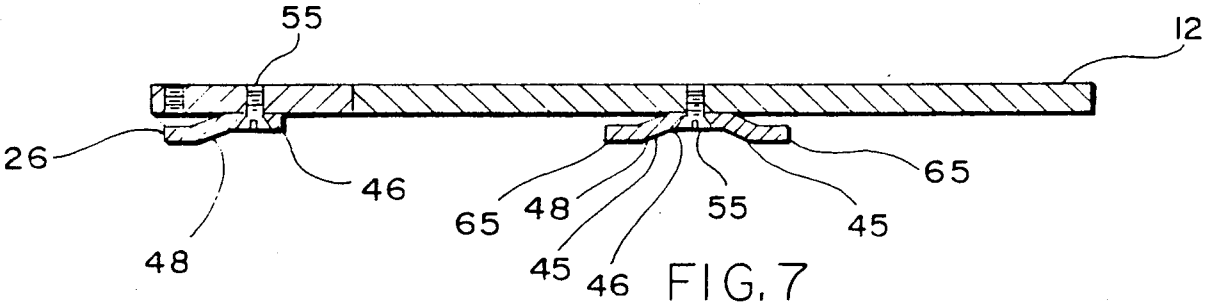
FIG. 7 is a longitudinal sectional view of the spring plate and springs taken along section line 7—7 of FIG. 6.

An alternative embodiment utilizing a spring plate is shown in FIG. 6. There it will be seen that the spring plate 12 has secured to it a plurality of beam springs 27, each of which is secured by means of a bolt 55 at its mid-portion so that the extending ends all extend downwardly. Instead of a star spring 22, springs in the form of cantilever springs 26 having a cantilever portion 48 are secured by the mounting bolts 55 to the spring plate 12. Turning now more specifically to FIG. 7, there it will be seen how the individual ones of the subject springs 26 are secured to the spring plate 12. FIG. 7 is taken essentially along section line 7—7 of FIG. 6. In the foregoing embodiments the spring plate 12 may be made thicker in its central portion surrounding the collector nozzle to thereby reduce plate deflection.

The utilization of an uncanned-unbanded refractory plate and associated collector nozzle 18 is shown in FIG. 8. The collector nozzle 18 is held in place by means of the threaded dependency 29 as it is secured to the upper portion of the nozzle holder 14. Clamp ring 13 is then secured by means of bolts 10 to the spring plate 12.

A further alternative to the embodiment just described results from the elimination of the spring plate 12, and instead securing the springs as shown in FIG. 6 directly to the upper portion of the carrier. With this embodiment, a spring plate 12 is not used. The springs bear directly against the underneath portion of the metal encased sliding gate refractory as shown in FIGS. 1 and 5. In short, the individual springs of the second embodiment as illustrated in FIG. 6 with the spring plate 12 can be substituted as an alternative for the ring and spider-like construction shown in FIG. 3.

Figure 9:
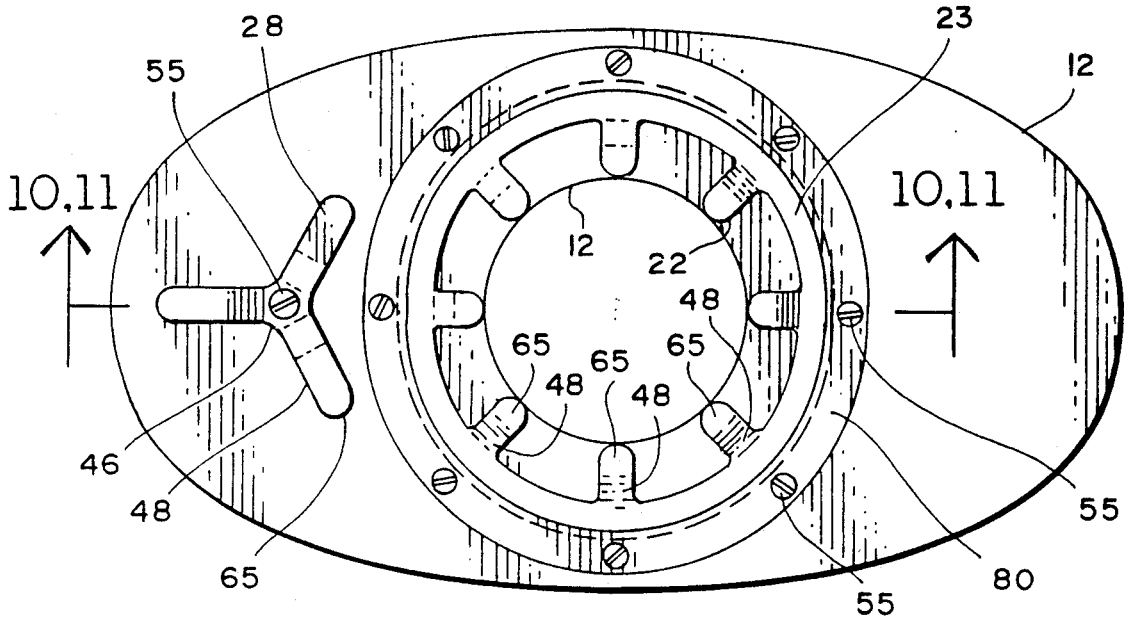
FIG. 9 is a plan view of an alternative embodiment spring plate.
Figure 10:
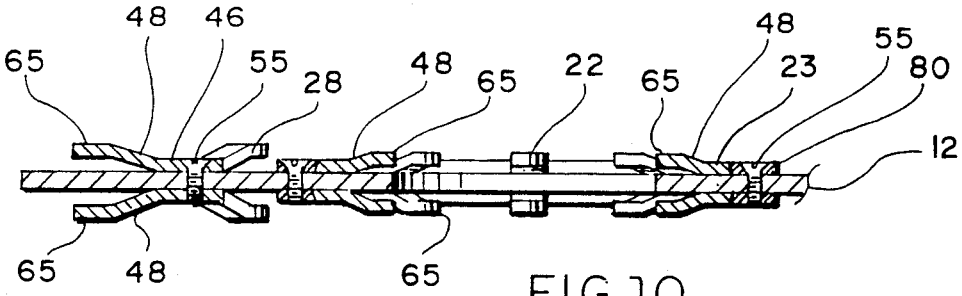
FIG. 10 is a transverse sectional partially broken view of the Spring plate shown in FIG. 9.
Figure 11:
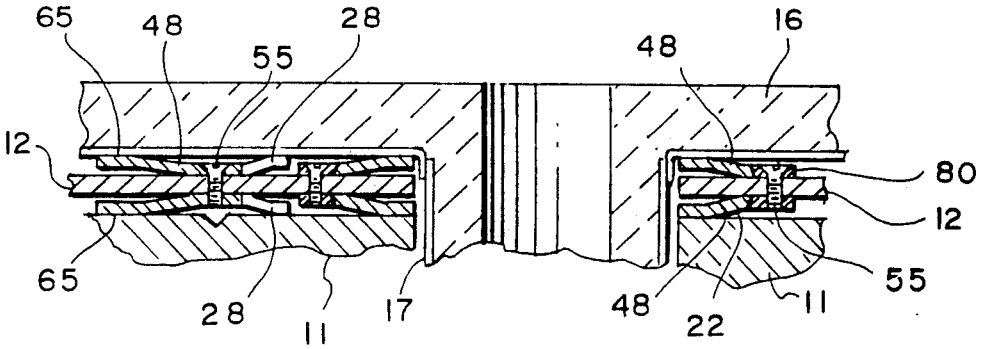
FIG. 11 is yet another transverse sectional view of the spring plate shown in FIGS. 9 and 10 but in its compressed relationship with a sliding gate.

In the further alternative embodiment of the spring plate shown in FIG. 9, a star spring 22 version is shown where the star springs 22 extend interiorly of a heel ring 23. The heel ring 23 is secured by means of clamp 80 and mounting bolts 55. As shown, the working face 65 of the star springs 22 cantileverly engage the underneath portion of the slide plate. To underlie the plate in the shut-off position, a further three-leaf spring 28 is offset from the star springs 22 and secured by means of mounting bolt 55 at the heel portion 46 of the cantilever portion 48 of the springs which terminate in a working face 65. The same are all shown in transverse view in FIG. 10 where it becomes apparent that a plurality of springs, each opposing the spring plate 12 in mirror image, provide for a one-half spring rate and double deflection. FIG. 11 is yet another view of spring plate 12 as shown in FIGS. 9 and 10 but taken along section line 11—11 of FIG. 9 and showing the same in its compressed relationship to the slide gate plate 16 and the carrier 11 of the valve assembly 5.

Figure 12:
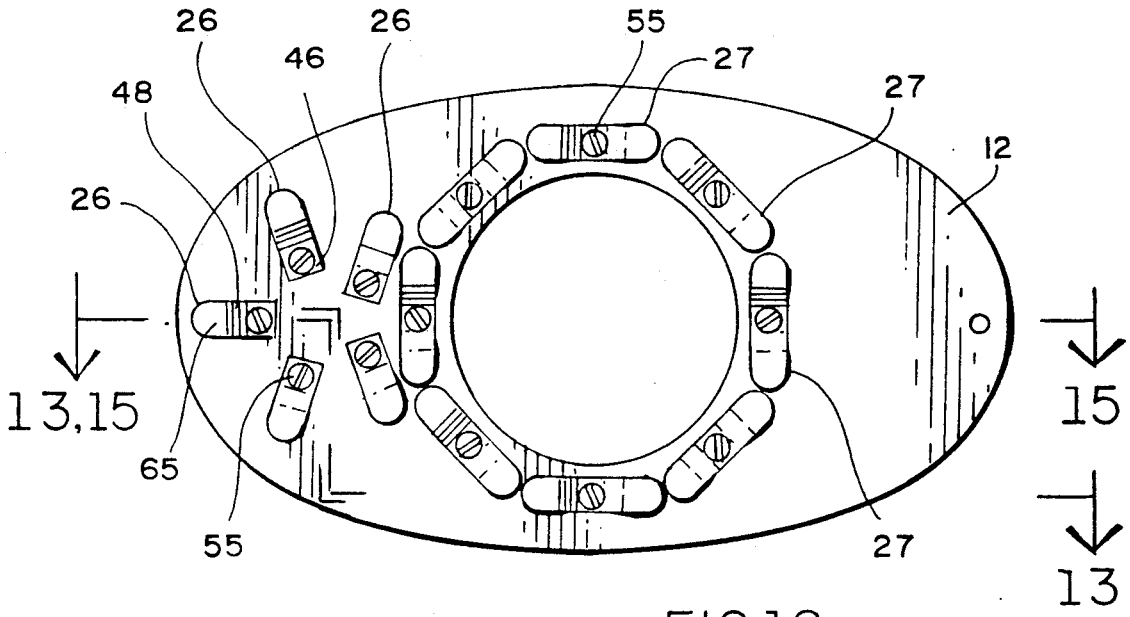
FIG. 12 is an alternative embodiment spring plate with different types of springs.
Figure 13:
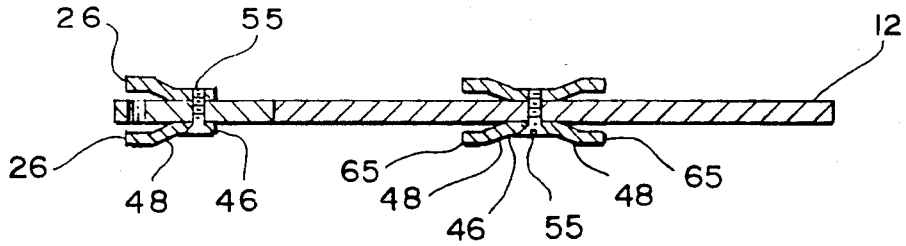
FIG. 13 is a transverse sectional view of the alternative embodiment spring plate shown in FIG. 12 taken along section line 13—13 of FIG. 12.
Figure 15:
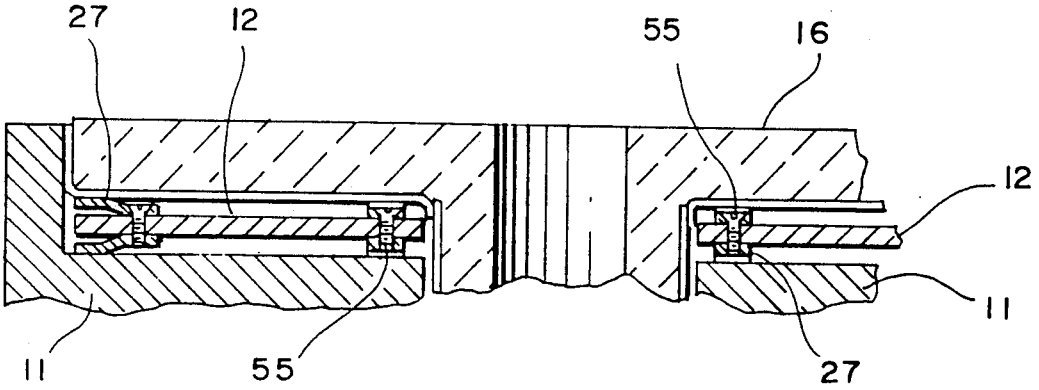
FIG. 15 is a transverse sectional view of the double spring plate of FIG. 12 taken along section line 15—15 thereof.

Yet another embodiment spring plate 12 is shown in FIGS. 12, 13 and 15. It is distinguishable from the embodiment shown in FIGS. 9, 10 and 11 inasmuch as individual double working face springs 27 are employed instead of the star springs. Similarly, instead of the spider-like spring underneath the shut-off portion, a plurality of cantilever springs 26 having a cantilever portion 48 secured to a heel portion 46 are mounted by bolts 55. The double leaf presentation is best illustrated in FIG. 13 and shown in its host environment in FIG. 15 where the spring plate 12 and its springs engage the sliding gate 16 of the valve 5 and is sandwiched therebetween and the carrier 11.

Figure 14:
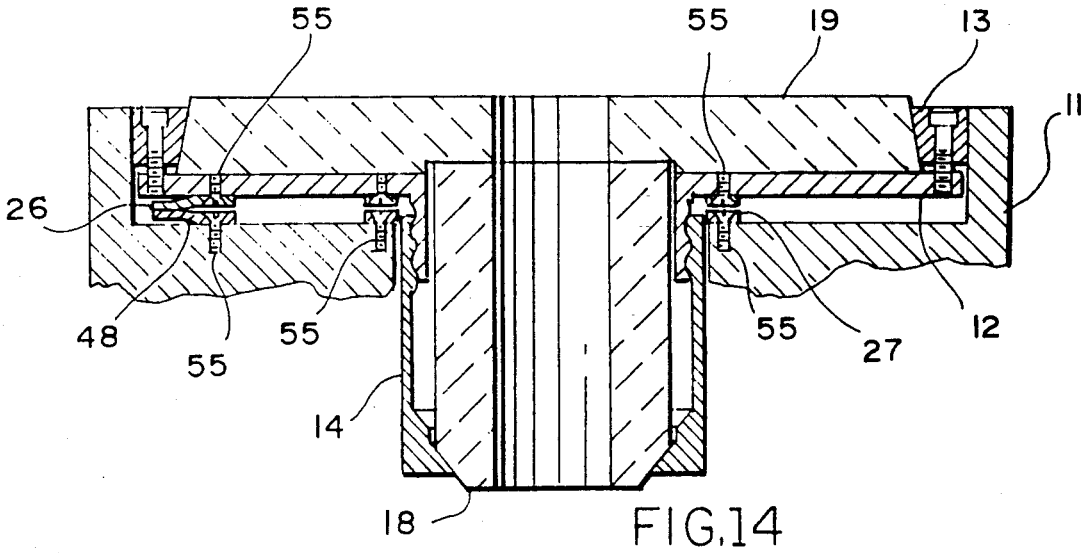
FIG. 14 is yet another embodiment in which the spring plate is utilized with a bandless refractory and double springing is involved between the springs on the lower portion of the spring plate and the upper portion of the carrier.

FIG. 14 shows yet another alternative embodiment of the spring plate 12 where the spring plate 12 serves to mount the clamp ring 13 when employed with an uncanned slide gate 19. The replaceable collector nozzle 18 is secured in place by means of the nozzle holder 14 through its threaded upper end portion.

Figure 16:
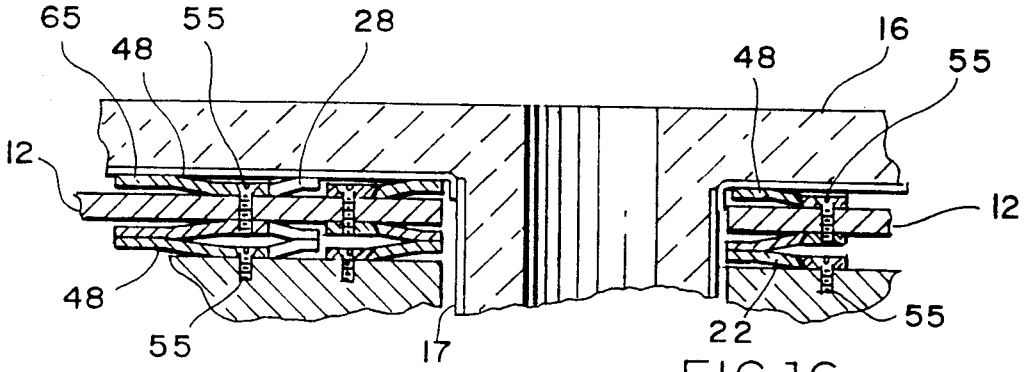
FIG. 16 is a transverse sectional view of the double spring plate of FIG. 12 taken along section line 15—15 thereof but actually showing one additional set of springs on top of the spring plate and abutting an encased refractory member.

FIG. 16 shows the first embodiment of a modified double leaf spring where the underneath portion of the spring plate 12 has its cantilever springs mounted to engage comparable springs on the carrier. Additional springs are mounted with the cantilever portion 48 secured by means of the mounting bolt 55 with a working face 65 extending upwardly to engage the lower encased portion of the slide gate plate 16.

Figure 17:
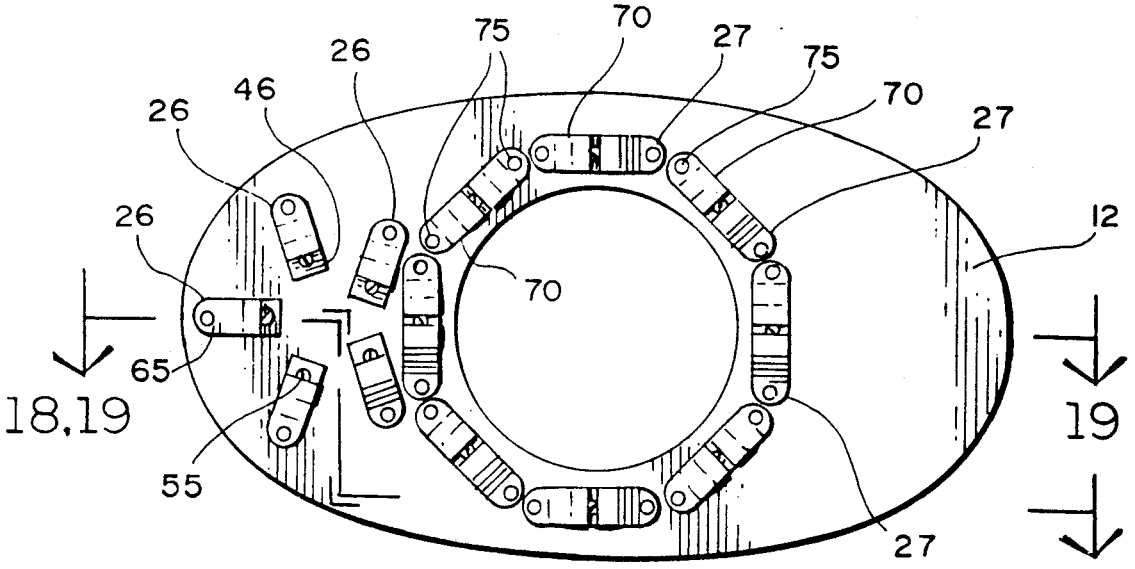
FIG. 17 is a plan view of yet another alternative embodiment in which the leaf springs are double sprung on the underneath side portion of the spring plate.
Figure 18:
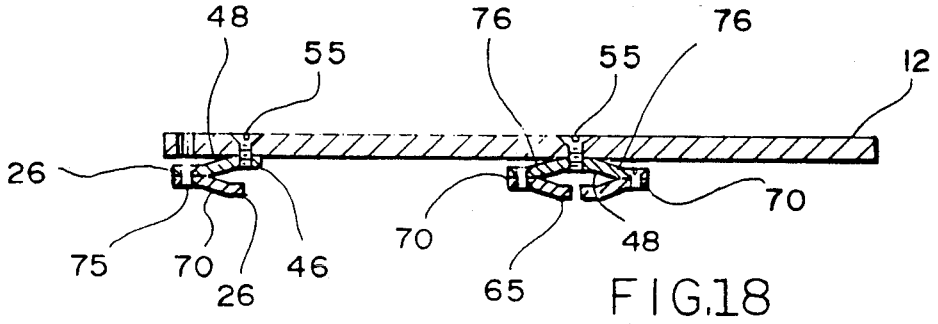
FIG. 18 is a sectional view taken along section line 18—18 of FIG. 17 showing the double spring springs on the underneath portion of the spring plate so that the spring plate can engage a bandless refractory.

Carrying on with the spirit of double springing, this is accomplished primarily as shown in FIGS. 17 and 18 where a double spring assembly 70 is formed by securing two cantilever springs 26 with a mounting leaf and connecting leaf 71, 72 secured by means of a doubler fastener 75. Actually, the central double spring 70 has a double beam portion 76 secured by means of mounting bolt 55 to the spring plate 12.

Figure 19:
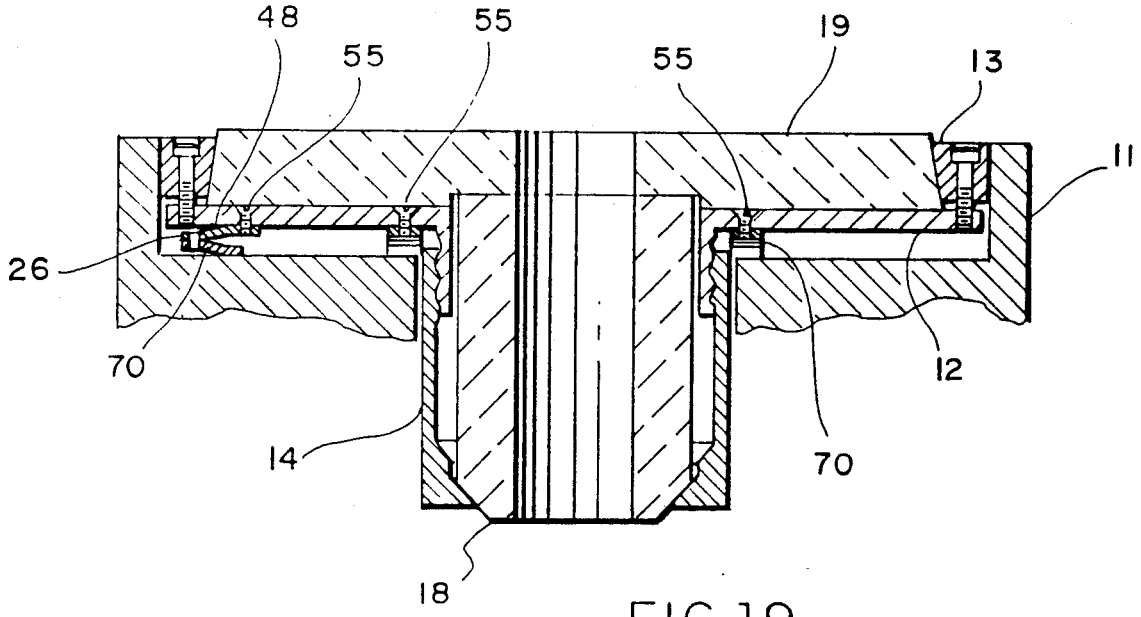
FIG. 19 is taken along section line 19—19 of FIG. 17 showing the bandless refractory member in place with the souble spring assembly beneath the spring plate.

FIG. 19 discloses an embodiment in which the spring plate 12 secures the clamp ring 13 in place to engage the uncanned slide gate 19. Necessarily with the uncanned refractory 19 the upwardly extending springs as shown in FIG. 16 are omitted in favor of the double spring assembly 70 beneath the spring plate 12.

Figure 20:
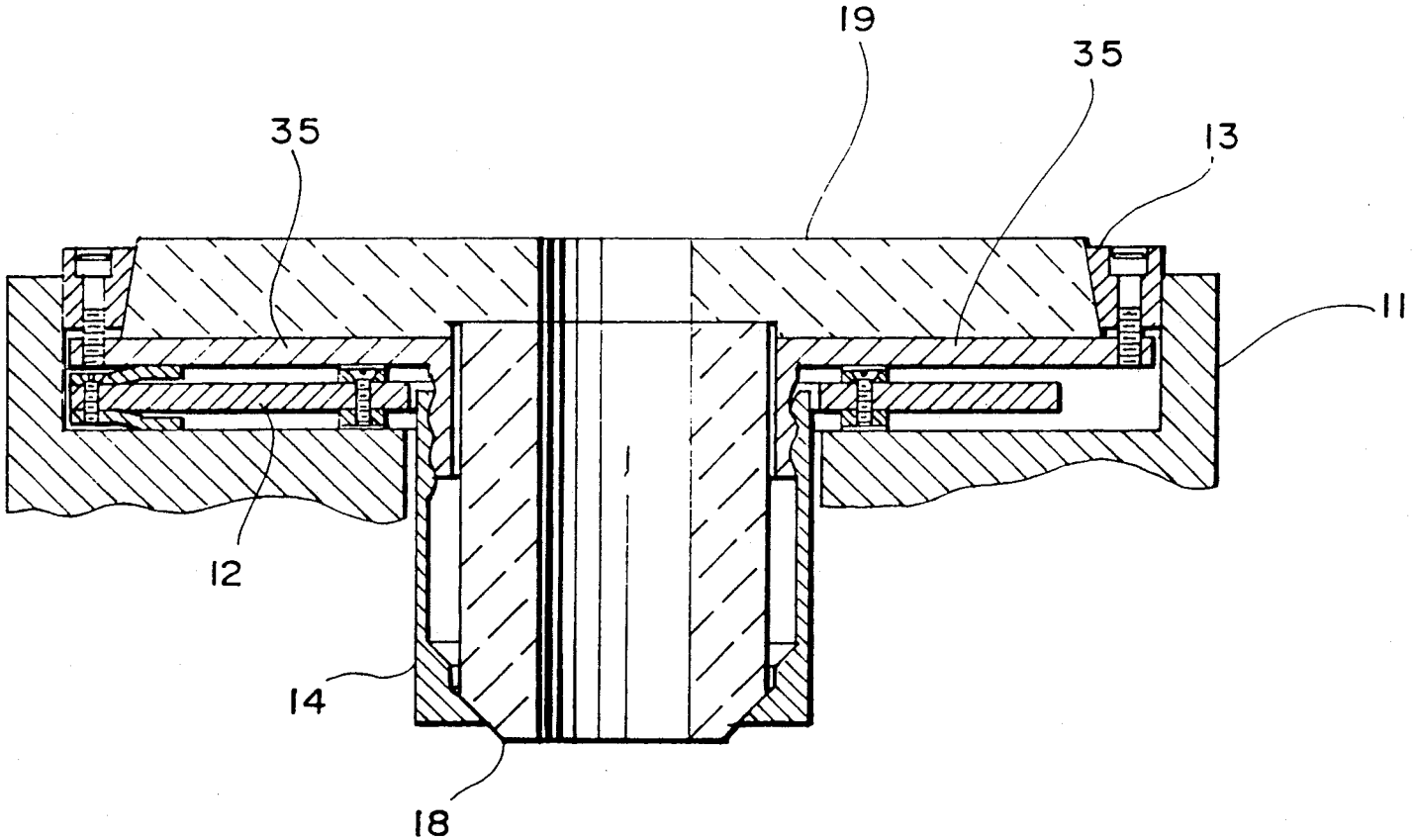
FIG. 20 is yet another alternative embodiment in which both a spring plate and a pressure plate are employed.

Yet another embodiment of the utilization of the springs illustrative of the present invention can be described by reference to FIG. 20. There it will be seen that the spring plate 12 has springs on both sides. The spring plate 12 is combined with a pressure plate 35. The pressure plate 35 serves to distribute the load of the springs on spring plate 12 over the face of the refractory, and also to secure the bandless refractory to the pressure plate by means of clamp ring 13. The spring rate of the system becomes that of the spring plate of FIGS. 9–15 which is one-half of the normal since the spring plate 12 of FIG. 20 has springs on both the upper and the lower face.

The materials employed for the beam springs just described are generally known as high speed tool steel.

They possess high strength and heat resistance, and are relatively inexpensive. Such materials substitute for the rather exotic type materials employed with the coil springs. Actual tests have shown that the coil springs which are replaced by this invention are designed to operate below 900° F. and are of rather expensive exotic metals such as maragin steels.

The machinable steel as employed with the springs disclosed herein can operate at temperatures up to 1200° F. In an actual test report a block of steel comparable to the cantilever spring disclosed, but in a totally different environment and configuration, will flex over five hundred thousand times at a temperature of 1000° or more.

The advantages which flow from reducing the spring rate are significant. If we assume that the range of sealing force from minimum to maximum for any one size refractory set, size being based upon surface area, is fixed and must be maintained; if the spring rate of the system is cut in half, then the dimensional stack-up variation tolerance of the system is doubled. If we assume, for example, that the allowable force range for a valve system is 5000 kgf to 7000 kgf and the spring rate is 2000 kgf per millimeter, the total allowable stack-up variation tolerance including refractory tolerance and mechanical tolerance range combined is 1 millimeter or +/−0.5 millimeter from nominal. A double spring application of the same components reduces the rate to 1000 kgf per millimeter and makes the stack-up variance tolerance 2 millimeters or +/−1 millimeter from nominal. A triple stack spring with the same components results in an effective rate of 667 kgf per millimeter and allows a +/−1.5 millimeter variation.

The greater the stack-up variation tolerance a system will accommodate, the more forgiving the system is of refractory manufacturing tolerances, the chemical manufacturing tolerances, and mistakes made in "making up" the system for service. Larger allowable manufacturing tolerances tend to relate to lower costs. Conversely stated, as manufacturing tolerances approach zero defect, the cost of production increases significantly. The more forgiving a system is of mistakes in setting it up for use, the fewer operating problems it will have. A lower spring rate may allow, but does not force, a system to be able to use remanufactured plates. Finally, when the spring rate of the system is cut in half, or more, the effects of thermal expansion and distortion are also cut in half, or more.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A sliding gate valve for a vessel containing molten metal comprising, in combination, a mounting plate, means for securing the mounting plate to said vessel containing molten metal, means for conveying the molten metal through the vessel wall and mounting plate, said valve having a top plate loaded against the mounting plate, a frame, a carrier for reciprocation in said frame, a spring plate having a central aperture for receiving a collector nozzle, a sliding gate positioned in the carrier and having a depending collector nozzle passing through the spring plate aperture, a plurality of inverted beam springs with pressure points extending outwardly from aperture of the spring plate, a plurality of cantilever springs offset on one portion of the spring plate and therebetween into the carrier, said slide plate having continuous curved edges for being secured to the pressure plate, said slide plate refractory having a shutoff portion for underlying the top plate when in the shut off condition, and means in the carrier for pressure engaging relationship to the beam springs of the spring plate in surrounding relationship to the teeming orifice.

2. A spring plate for use with a sliding gate valve positioned beneath one of two or more refractory plates, the first one being a stationary plate secured at the upper portion of the valve and in teeming communication with a vessel containing molten metal, the second being positioned below the first and in sliding relationship therewith, both said plates having teeming orifices which when positioned in and out of register will respectively permit the teeming of fluid metal and stop the same, said spring plate comprising, a plate of planar configuration substantially the same as its slide gate refractory mounted thereto, a plurality of cantilever springs secured beneath the spring plate and exteriorly thereof and tangentially outward therefrom to engage a carrier, said spring plate having a center section thickened in a tapered fashion from the lateral edges and the longitudinal edges therefrom, whereby upon achieving elevated temperature and reverse bending load from the cantilever springs the pressure plate resists deflection at its central portion which surrounds the teeming opening in its associated pressure plate.

3. A method of teeming steel from a ladle gate valve having a frame and movable carrier, and a stationary plate, sliding plate, spring plate beneath the sliding plate, and in which said stationary plate and sliding plate are of the bandless refractory type having a tapered edge and a mating taper ring surrounding the same which tapered ring upon being secured to its adjacent mounting surface exerts a central and downward force component, the method steps of:

mount a plurality of cantileverly mounted springs to the underneath portion of the spring plate to engage a flat surface interiorly of the carrier employed for the spring plate and slide plate, and secure a cluster of springs beneath said spring plate in its shutoff portion, whereby the necessity for external air to cool the springs is eliminated and the springs will readily transfer a load proportioned to the sealing of the valve to the interface between the stationary plate and the slide gate for reciprocating relative movement therebetween.

4. A ladle gate valve for a vessel containing molten metal comprising, in combination, a mounting plate, means for securing the mounting plate to said vessel containing molten metal, means for conveying the molten metal through the vessel wall and mounting plate, said valve having a top plate loaded against the mounting plate, a frame, a carrier for reciprocation in said frame, a metal encased sliding gate having a depending collector nozzle for insertion in the carrier;

a plurality of beam springs secured to the carrier with pressure points extending upwardly from said carrier in surrounding relationship to the sliding gate depending collector nozzle, and offset beam springs on one portion underneath the slide gate and therebeneath in the carrier, said springs bearing directly on the underneath portion of the slide gate.

5. A ladle gate valve for a vessel containing molten metal comprising, in combination, a mounting plate, means for securing the mounting plate to said vessel containing molten metal, means for conveying the molten metal through the vessel wall and mounting plate, said valve having a top plate loaded against the mounting plate, a frame, a carrier for reciprocation in said frame, a metal encased sliding gate having a teeming opening for insertion in the carrier, a pressure plate for load distribution and attachment of a collector nozzle, a plurality of beam springs secured to the carrier with pressure points extending upwardly from said carrier in surrounding relationship to the sliding gate pour opening, and offset cantilever springs on one portion underneath the slide gate and therebeneath in the carrier, said springs bearing directly on the underneath portion of said pressure plate.

6. In a sliding gate valve, wherein a reciprocating gate is used with said valve for discharging fluids from a vessel, wherein the reciprocating gate is engaged at its lower portion by yieldable means and having a teeming orifice at a portion thereof; and a stationary top plate with a teeming orifice and having a refractory face in relative slidable relationship to a refractory face on the reciprocating gate; and where the yieldable means promote sealed face to face reciprocating gate refractory face, the combination with said valve of a simple beam spring, the simple beam spring comprising, a simple beam formed or machined from high strength heat resistant metal, said beam having a cantilever load resistance flexing portion, a load application portion, and a means for affixing a simple beam spring at the end of the load resistance portion remote from the load application portion.

7. In the spring of claim 6, said spring being a cantilever beam.

8. In the spring of claim 6, said spring being a multi-leaf cantilever spring.

9. In the spring of claim 6, said spring being a ring form star spring with independent cantilever fingers.

10. The spring of claim 6, said spring being a single leaf spring.

11. For use with a sliding gate valve, said valve having a reciprocating gate used with said valve for discharging fluids from a vessel, yieldable means engaging the reciprocating gate at its lower portion, said reciprocating gate having a teeming orifice at a portion thereof; and a stationary plate opposed to said reciprocating gate also having a teeming orifice and having a refractory face for relative slidable relationship with the refractory face on the reciprocating gate; a carrier for mounting the reciprocating gate in face to face relationship with the slide gate, and wherein the yieldable means promotes sealed face to face contact with the reciprocating gate refractory face, said yieldable means comprising a simple beam spring characterized by being machined from a high strength heat resistant metal, said spring having a load resistance portion, and a load application portion, and means for affixing the spring at the load resistance portion with the balance of the spring cantileverly engaging the reciprocating gate.

12. In the sliding gate valve spring mechanism of claim 11 above, said spring comprising a heel ring and a plurality of yieldable star spring members extending centrally from said heel ring, said heel ring being mounted to the carrier with the star springs extending into yieldable and urging relationship with the stationary plate.

13. In the sliding gate valve spring mechanism of claim 11 above, said yieldable members comprising a plurality of springs, each said springs having a cantilever resistance portion and a mounting base portion, and means for securing said mounting base portion to the carrier to the end that the resistance portion will cantileverly engage the underneath portion of the sliding gate.

14. In the sliding gate valve spring mechanism of claim 11 above, a spring plate, said spring plate substantially underlying the sliding face portion of the reciprocating gate, and said yieldable spring means mounted on the upper portion of said spring plate and engaging the underneath portion of the sliding plate.

15. For use with a sliding gate valve, said valve having a reciprocating gate, said valve having a stationary plate, yieldable means for urging the reciprocating plate in sliding face to face relationship with the stationary gate; and a carrier for securing the reciprocating gate in face to face relationship with the stationary gate, the improvement comprising, a spring plate, said spring plate having spring means secured to it, said spring mean comprising a heel ring and a plurality of yieldable star spring members extending upwardly therefrom, said heel ring being mounted to one face of the spring plate for yieldable engagement with the reciprocating gate.

16. In the sliding gate valve of claim 15, said heel and star springs being secured to the underneath portion of said spring plate.

17. In the sliding gate valve of claim 15, said heel and star springs being secured to the upper portion of said spring plate.

18. In the sliding gate valve of claim 15, said spring plate having yieldable means secured to its upper portion and its lower portion, said yieldable means being of the cantilever type, one portion of said yieldable cantilever means secured to the upper portion of said spring plate engaging the reciprocating gate;

and the other yieldable cantilever means secured to the lower portion of said spring plate for engaging the carrier, whereby the spring rate is cut in half and double deflection will be achieved for applying the same load to the opposed refractory plates.

19. A spring plate for use with a sliding gate valve, said valve having a reciprocating gate, said valve having a stationary plate, said valve having a carrier for securing the reciprocating gate in face to face relationship with said stationary plate, said spring plate positioned between the carrier and the slide plate, with the improvement comprising, a plurality of yieldable cantilever springs secured to one face of said spring plate.

20. In the spring plate of claim 19 above, said spring means comprising a plurality of cantilever springs having a resistance lever portion and a mounting base, and means for mounting said base to said carrier.

21. In the spring plate of claim 19 above, said individual springs being mounted on the upper side of said spring plate.

22. The spring plate of claim 19 above, in which said yieldable individual springs are mounted on both the upper side and the underneath side of the spring plate.

23. In the spring plate of claim 19 above, said spring plate having spring means secured to it, said spring means comprising a heel ring and a plurality of yieldable star spring members extending upwardly therefrom;

said heel ring being mounted to one face of said spring plate.

24. In the spring plate of claim 19 above, said heel ring being secured to the upper portion of said spring plate.

25. In the spring plate of claim 19 above, said heel ring being mounted to the underneath portion of said spring plate.

26. In the spring plate of claim 19 above, said heel ring being mounted to both the faces of the spring plate, whereby the spring rate is cut in half and double deflection is achieved for applying the same load to the opposed refractory plates.

27. For use with a sliding gate valve, said valve having an upper stationary plate, said valve having a lower stationary plate, said valve having a reciprocating intermediate plate; each said plate having a teeming orifice therein, and means for securing the three plates in face to face relationship, in addition having means for driving the metal plate, the improvement comprising, a plurality of cantileverly mounted springs located interiorly of the means for securing the three plates and positioned to engage the lower most stationary plate of said three plates.

28. In the sliding gate valve of claim 27 above, said yieldable means comprising a heel ring and a plurality of yieldable spring members extending upwardly therefrom, said heel ring being mounted to the upper portion of the carrier for yieldable engagement with the lower stationary plate.

29. In the sliding gate valve of claim 27 above, a plurality of yieldable springs secured to the carrier and engaging the lower of said stationary plate, said yieldable means comprising both star springs and individual yieldable cantilever springs, said springs being in surrounding engagement with the teeming orifice of the lower stationary plate.

30. For use with a sliding gate valve, said valve having an upper stationary plate, said valve having a lower sliding gate, said valve having a carrier for securing the sliding plate in sliding relationship to the stationary plate, means for driving the sliding plate in a reciprocatory fashion, each of said plates having a teeming orifice, said driving means carrying the same in and out of register, the improvement comprising, in combination, a spring plate and a pressure plate, said pressure plate underlying a bandless refractory and having means on its outer portion for clampingly engaging said bandless refractory to said pressure plate, and a spring plate having a plurality of springs extending from at least one face interposed between said pressure plate and said carrier.

31. In the assembly of claim 30, a plurality of springs on the upper face and the lower face of said spring plate, whereby said spring plate provides for one-half the spring rate normally associated with valves having but single springs urging the sliding plate in pressure face-to-face relationship with the stationary plate.

* * * * *